US010704865B2

(12) United States Patent
Steenson, Jr. et al.

(10) Patent No.: US 10,704,865 B2
(45) Date of Patent: Jul. 7, 2020

(54) LASER DESIGNATION VERIFICATION TOOL

(71) Applicant: BAE SYSTEMS Information and Electronic Systems Integration Inc., Nashua, NH (US)

(72) Inventors: James H. Steenson, Jr., New Boston, NH (US); Derek P. Janiak, Manchester, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 207 days.

(21) Appl. No.: 15/669,640

(22) Filed: Aug. 4, 2017

(65) Prior Publication Data

US 2019/0041165 A1 Feb. 7, 2019

(51) Int. Cl.

| | |
|---|---|
| ***G01C 3/08*** | (2006.01) |
| ***F41G 7/00*** | (2006.01) |
| ***F41G 7/30*** | (2006.01) |
| ***F41G 7/22*** | (2006.01) |

(52) U.S. Cl.

CPC ..... *F41G 7/001* (2013.01); *F41G 7/007* (2013.01); *F41G 7/226* (2013.01); *F41G 7/2293* (2013.01); *F41G 7/301* (2013.01)

(58) Field of Classification Search

CPC ..... F41G 7/001; F41G 7/226; F41G 7/2293; F41G 7/007; F41G 7/301

See application file for complete search history.

(56) References Cited

U.S. PATENT DOCUMENTS

| | | | | |
|---|---|---|---|---|
| 5,206,455 | A | 4/1993 | Williams et al. | |
| 5,367,458 | A | 11/1994 | Roberts et al. | |
| 2007/0264616 | A1* | 11/2007 | Namgung | F41A 33/02 434/16 |
| 2013/0070239 | A1 | 3/2013 | Crawford et al. | |
| 2015/0346722 | A1 | 12/2015 | Herz et al. | |

OTHER PUBLICATIONS

International Search Report, PCT/US2018/045083, dated Oct. 16, 2018, 13 pages.

* cited by examiner

*Primary Examiner* — Samantha K Abraham
(74) *Attorney, Agent, or Firm* — Finch & Maloney PLLC; Scott J. Asmus

(57) ABSTRACT

Techniques are provided for a laser designation verification device and a method of laser designation verification using the device. The laser designation verification device includes: a lens to sense a first reflection, the first reflection coming from an encoded first laser beam reflecting off a first target; an electronic processing element to decode the sensed first reflection into a first code; and a portable electronic annunciator to provide identification of the first target to an operator of the device based on the decoded first reflection. The method includes: sensing a first reflection using the lens, the first reflection coming from an encoded first laser beam reflecting off a first target; decoding the sensed first reflection into a first code using the processing element; and providing, by the annunciator to an operator of the device, identification of the first target based on the decoded first reflection.

18 Claims, 8 Drawing Sheets

700

800

LASER DESIGNATION VERIFICATION TOOL

FIELD OF DISCLOSURE

The present disclosure relates to a laser designation verification tool.

BACKGROUND

Precision or precision-guided weapon systems, such as laser guided munitions on military aircraft, reduce the risk of collateral damage (e.g., to friendly forces, non-military targets, civilians, etc.) during military operations. Such weapons are often lock on after launch (LOAL) weapons (e.g., their guidance systems do not identify or acquire their intended targets until after the weapons are launched). Ground personnel and pilots sometimes desire confirmation that a laser is adequately designating a target, or that the target will be within the weapons acquisition field of view (FOV), such as prior to release of the weapon. At times, air crews may even lack confidence and be reluctant to deploy such weapons in situations where the weapons are needed. Traditional systems for providing the above confirmation can require highly invasive interfaces between the weapon (e.g., missile) and the platform launching the weapon.

BRIEF DESCRIPTION OF THE DRAWINGS

Features of embodiments of the claimed subject matter will become apparent as the following Detailed Description proceeds, and upon reference to the Drawings, wherein like numerals depict like parts.

FIG. 3, which includes

Figure 1:
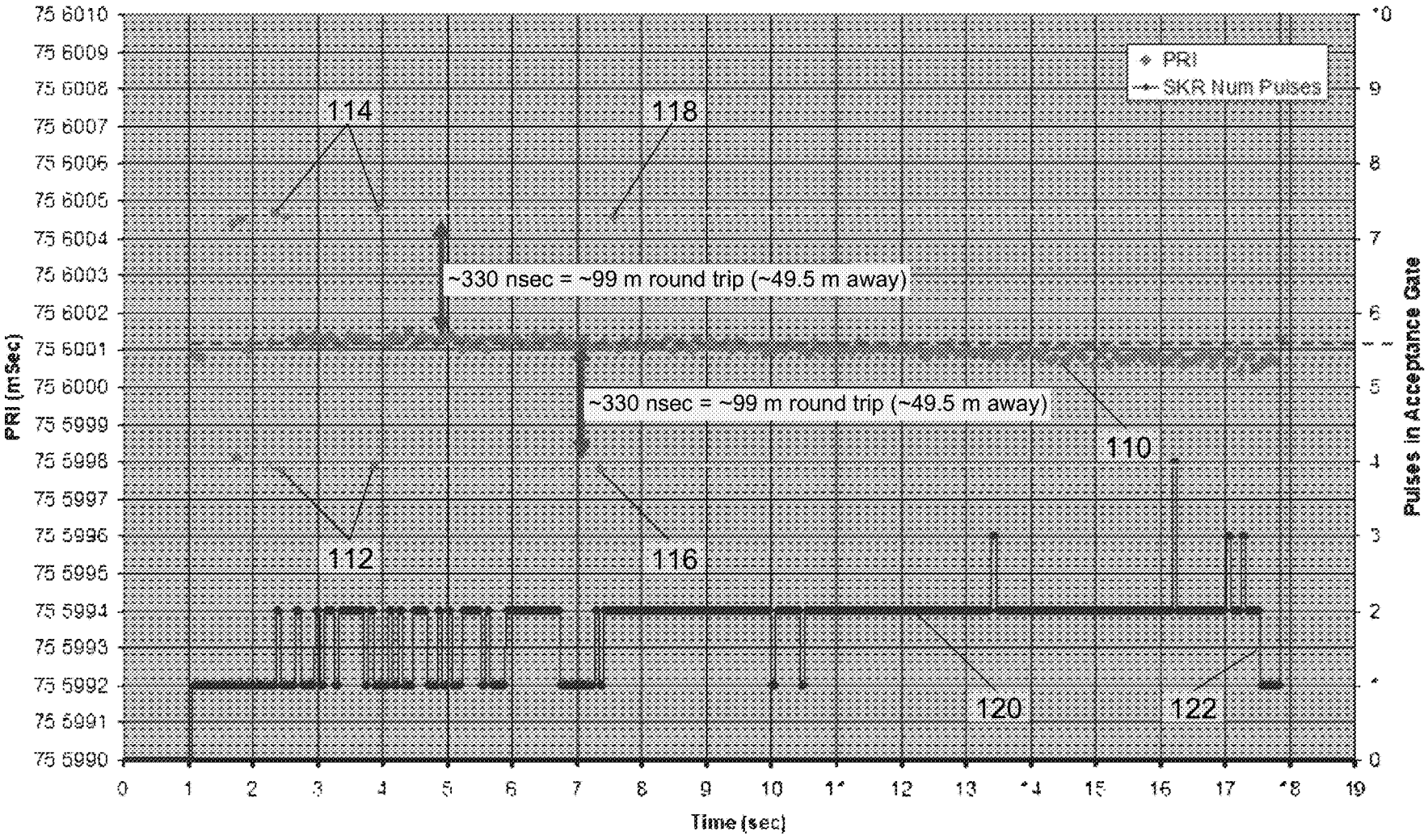
FIG. 1 illustrates an example timeline of various munition targeting information sources available to a seeker guiding a precision guided munition.

Although the following Detailed Description will proceed with reference being made to illustrative embodiments, many alternatives, modifications, and variations thereof will be apparent to those in light of the present disclosure.

DETAILED DESCRIPTION

In one embodiment, a portable device provides target designation information and acceptable weapon acquisition FOV information in a self-contained system that requires no electrical interface to the platform. For example, the device can be secured in place with a mechanical interface, such as hook and loop fasteners (e.g., Velcro), straps, snaps, and the like. Precision-guided weapons (e.g., laser-guided missiles, rockets, and bombs) can be useful in warfare to carry out military objectives while reducing collateral damage. Such weapons can be delivered, for example, from aircraft (e.g., fixed-wing or rotary wing), using a combination of electronic tools and controls under the direction of a flight crew. Precision-guided weapons are often employed using a laser designator, which is usually separate from the weapons, and often separate from the platform (e.g., ground-based, on a different platform, to name a few). A laser designator illuminates an intended target with a laser beam (such as an infrared laser beam having a particular signature or code, e.g., a pulse repetition frequency (PRF) code, reflecting off the target). A laser seeker on the weapon (munition) tracks the reflected laser beam and directs the weapon to the intended target based on the reflected laser beam. The weapon is often launched prior to the seeker acquiring the target and guiding the weapon, such as a lock on after launch (LOAL) weapon.

Some embodiments of the present disclosure are directed to situational awareness devices, such as portable standalone devices (e.g., the size of a deck of playing cards, such as 2.25 inches wide by 3.5 inches long by 0.5 inches thick, or comparable dimensions, such as a thick smartphone or palm-size radar detector). The devices provide re-assurance to some air crews (or other weapons delivery personnel) such that they feel more comfortable employing a weapon (such as a precision guided weapon) without, for example, lock on before launch (LOBL), where weapons are only launched after the target has been identified and acquired by the weapons system. While such tools are not technically necessary to deliver LOAL weapons, they increase the confidence before deployment that an appropriate signal is being returned from the target, which helps pilots and their crews to better carry out their tasks. Such a portable device is analogous to an automobile radar detector (e.g., palm-size, with a straightforward purpose and functionality).

According to some embodiments of the present disclosure, this functionality, once calibrated, provides pilots or other air crew members valuable information such as verification of firing conditions, target designation is at the correct laser code (e.g., the pulse repetition frequency (PRF) of the laser designator matches that of the weapon), and potentially the expected probability of a hit, before deploying the weapon. Additionally, the device may confirm the presence of multiple valid laser codes in the weapons field of view, or confirm inadvertent multiple instances of the same code, which could, for example, result in the weapon attacking a target other than the one intended. It should be noted that, for ease of description, most of the example embodiments described herein are directed to an aircraft-based weapons platform (e.g., fixed or rotary wing), with intended deployment of the device or other techniques taking place on the aircraft. However, other embodiments are not so limited, for example, the weapons platform may be ground-based, and the techniques may be used or take place on the ground.

For precision-guided weapons systems, military pilots do not necessarily have laser verification of spot on target, or weapon is within system parameters, prior to launch of such weapons. Military air crews desire situational awareness devices, particularly such devices that are portable and not integrated with existing weapons systems or other aircraft avionics (e.g., operate independently or not under direct control or power of the aircraft's systems, such as a stand-alone tool). While the information provided by such devices may not be necessary for the air crews to employ the weapons systems, such as LOAL weapon systems (that can be targeted after launching from the aircraft), these devices can enhance confidence in flight crews to enable better deployment of the weapons. For example, many air crews are reluctant to deploy a precision guided weapon without confidence that the laser designator is on and producing a signal, such as an appropriate pulse repetition frequency (PRF) that matches the weapon to the intended target. Other systems that can provide such information to the flight crews require highly invasive interfaces between the missile and the platform.

According to some embodiments of the present disclosure, portable, possibly battery-operated devices are provided that sit on the glare shield and operate (e.g., sense) through the windscreen of the aircraft. For example, in operation of one embodiment, the portable tool receives the incident reflected signals that are processed by the optical detector. In other embodiments, any placement with clear view of the battlefield or intended target will work. In some embodiments, the device is mounted externally, with the device's displays being clearly viewable from within the crew cabin. In still other embodiments, the device is mounted externally with a simple remote annunciator. In yet still other embodiments, the remote annunciation takes place on existing multifunction or heads-up displays.

In one or more embodiments, an optic in the device provides a field of view encompassing potential targets (e.g., one, two, three, or more potential targets) of laser-guided weapons (e.g., targets capable of being engaged by the aircraft), such as a wide angle forward view. In one or more embodiments, the device is based on a subset of the hardware and temporal correlator used in existing guided munition seekers (e.g., such as recognizing and authenticating the laser designator signal) or uses a seeker or more limited seeker. In other embodiments, other hardware and algorithmic topologies are used to provide the laser designator tracking and verification functionality. One example of a seeker is the Distributed Aperture Semi Active Laser Seeker (DASALS).

For example, the optic (e.g., lens) may be configured to sense reflected laser beams operating in the visible or near visible ranges, such as infrared. In some embodiments, a filter may be used to remove reflected signals sensed by the optic that do not correspond to laser reflections or laser reflections in the desired wavelengths. Further, an electronic processing element or elements, such as an avalanche photodiode (APD), an analog to digital converter (ADC), and a microprocessor or field-programmable gate array (FPGA), may be programmed or otherwise configured to interpret the sensed (and filtered) laser beam reflections, such as decoding them into a pulse repetition frequency (PRF) code used by laser designators to illuminate targets for smart munitions.

While embodiments of the present disclosure are illustrated with an FPGA or microprocessor to perform the computing portions of the laser designation verification tools, other embodiments of the present disclosure are not necessarily so limited. For example, in some embodiments, a custom logic circuit, a microcontroller, an application-specific integrated circuit (ASIC), a system on a chip (SOC), a complex programmable logic device (CPLD), or the like is used to perform the computing.

In some embodiments, the device has an on/off switch and one or more annunciators, such as an audible indicator, segment (decimal digit) display or set of several (e.g., two to four, or more) indicator, such as light-emitting diode (LED) lights, or a multi-digit digital display (e.g., a display using two or more digits, such as four) and possibly other annunciators or aural sounders, some of which may be deployed remotely from the device (such as in a location more viewable to the air crew than the location of the device). According to some embodiments, the device does not need high angular accuracy (for example, unlike a seeker, the device does not control the flight path of the weapon to the target), such as when the device is just verifying that an appropriate laser designation signal (e.g., a single signal, with appropriate frequency and PRF code) is being detected in the field of view of a deployable laser-guided munition. The FOV of the device should be controlled to be approximately representative of the FOV that the launched weapon would experience.

In further detail, according to some embodiments, the laser designation-related parameters that are detected or confirmed for the air crew by the device include, but are not necessarily limited to, one or more of the following: the presence of one or more correlated target signals (e.g., confirming designation is taking place by the corresponding laser designator), signal strength (which can provide confidence in the target being properly and sufficiently designated by the laser), the number of target reflections in the last pulse logic (LPL) timing gate (indicative of over/under spill, such as too many or unintended targets being tracked or designated), the designation code or codes being detected (e.g., confirmation of the correct code or codes), the stability and continuity of the designation signal, an approximate probability of a hit ($P_{hit}$), battery status, other temporal designation information, etc.

By way of example, in some embodiments, in a multi-digit display version, when no designated target is visible, the device indicates an idle state (e.g., using a walking dash, etc.) In some embodiments, when a valid designator code is detected, the detected code is presented on the digital display, allowing the crew, for example, to confirm the code is correct. In some embodiments, the device indicates a strength of the signal (which, after characterization, may provide high expectation of the guided munition acquisition). In one or more embodiments, sunlight-readable indicator lights (e.g., LED, incandescent, chemical, or the like) are used for annunciating the different states or quantities observed or sensed by the device.

In some embodiments, when the device detects a non-singular designator code (e.g., a laser designator reflection that has a different code, frequency, or other characterizing feature from another laser designator reflection or desired code or frequency being verified), the display indicates the presence of a non-correlated laser designator signal. This may be used to confirm, for example, the presence of a laser designator but caution that there may be more than one in use or that the detected laser designator is not configured to guide the desired munition to its intended target. In other embodiments, the device correlates several designations simultaneously and provides all valid codes to the crew. In some embodiments, the device is configured to cycle through other data values listed above, for example, when critical designator code values are not being detected. Other embodiments may have other or additional features capabilities, as will be apparent in light of the present disclosure.

According to some embodiments, such a device provides information prior to the launch of a guided munition (such as a missile, rocket, or bomb) that there is a high likelihood of engagement (e.g., acquiring and delivering the guided munition to an intended target) without the expense of having a smart weapon (such as a weapon capable of lock on before launch) or requiring extra interfaces and controls, such as a data bus to the launcher. Further, in some embodiments, such a device saves considerable time and money to deploy since no formal aircraft integration (e.g., integration into existing aircraft avionics or power supply) is necessary. Rather, in some embodiments, the device is a portable standalone tool, deployed to collect the reflected optical signals. In one example, the device can sit on the glare shield (for example, attached by Velcro, a strap, adhesive, or the like) and be turned on and operated independently of the other aircraft controls (e.g., the other aircraft avionics may be completely unaware of the presence of the device).

According to some embodiments, a portable or installed device is provided to sense the reflected energy of a semi-active laser designator to verify radiant intensity is sufficient for engagement. The device further verifies proper and unambiguous coding is available to enable high designation confidence in lock-on after launch engagements.

System Architecture

According to one or more embodiments, the present device allows laser designation data to be detected and displayed in an easy format to a flight crew prior to launching a precision-guided munition. Such information can enable the flight crew to make a better decision if the circumstances were proper to deploy the munition. Thus, according to one embodiment, the present device can detect conditions like overspill (or spillover, e.g., laser designations from the same designator being received from both the intended target and a nearby target further from the laser designator) or under-spill (or spill-under, e.g., laser designations being received from both the intended target and a nearby target closer to the laser designator) occurring prior to launch, so the crew might elect to hold off until a better designation is available. Overspill can occur, for example, because the laser spot is large enough (e.g., far from the intended target) or the placement of the laser spot on the intended target is such that some of the spot misses the intended target and reflects off a further target as well.

In this light, FIG. 1 illustrates an example timeline of various munition targeting information sources available to a seeker guiding a precision guided munition during such an overspill scenario. In FIG. 1, a nearly 18 second timing window (from launch of the munition to delivery at the target) is illustrated, with time advancing from left to right in seconds as indexed by the x (horizontal) axis. There are two plots depicted in FIG. 1: a pulse repetition interval (PRI) plot 110 (the upper plot) and a number of pulses (e.g., potential targets, such as one, two, three, four, or more) plot 120 (the lower plot). The plots start displaying data just after one second into the munition flight, and finish shortly before 18 seconds (e.g., impact of the munition at a target).

In further detail of this example, the PRI plot 110 illustrates a plot of pulses, one dot per pulse, indicating the time since the previously received pulse from the (tracked) target, in milliseconds (msec), as indexed by the y (vertical) axis on the left. A laser designator is trying to illuminate an intended target for the guided munition. As such, the designator is transmitting an encoded laser beam in pulses, one pulse every 75.6 milliseconds (msec), which is the nominal PRI (roughly 13.2 pulses per second) in this case. In other cases, the PRI may be different. For example, the PRI may be faster (e.g., less time between pulses). PRF codes may be predefined, for instance, the may be standards set by organizations such as the North Atlantic Treaty Organization (NATO).

The seeker, in turn, receives the signal with roughly this frequency after the signal reflects off the target. By "roughly," it is to be understood that the received (reflected) PRI fluctuates from the nominal PRI depending on factors such as the distance between the designator and the target as well as the distance between the seeker (munition) and the target. In FIG. 1, for about 95% of the time, the PRI plot 110 stays very close to 75.6001 msec, gradually decreasing over time (as the munition gets closer to the target). It should be noted that the example flight test data in FIG. 1 is from a flight test of overspill and intended to describe some of the processing that takes place during a guided munition deployment. It should be understood that the PRF codes are defined by organizations and agencies such as NATO that establishes predefined codes and frequencies.

The other 5% of the time, the PRI plot 110 strays from the 75.6001 msec average received PRI by plus or minus about 330 nanoseconds (nsec), as can be seen by points 112 (approximately 330 nsec faster than the average received PRI) and points 114 (approximately 330 nsec slower than the average received PRI). This is caused by a secondary target about 50 meters (m) behind the intended target being illuminated by the same designator, the 330 nsec representing the difference in signal (round trip) path between the intended target and the secondary target (about 99 m, or 49.5 m away). Accordingly, the seeker may receive multiple reflections of the same pulse, each one from a different possible target. Depending on factors such as the seeking algorithm used by the seeker (e.g., track the strongest pulse, the pulse most consistently received, to name a few), only one such reflection (the tracked target) is treated as the received pulse for the PRI plot 110 and to guide the munition. As such, when the received PRI increases by 330 nsec (e.g., points 114), the seeker is switching to the secondary target from the intended target, and when the received PRI decreases by 330 nsec (e.g., points 112), the seeker is switching from the intended target to the secondary target.

The switching between intended target and secondary target by the seeker takes place 11 times in FIG. 1, the next to last of which is point 116 (when the seeker switches to the intended target) and the last of which is point 118 (when the seeker switches to the secondary target, and tracks it until impact). This switching phenomenon can be better appreciated in light of the number of pulses plot 120. In further detail, the number of pulses plot 120 illustrates a count of pulse reflections received by the seeker for each transmitted pulse by the designator, as indexed by the y axis on the right. Given the relatively sparse occurrence of pulses (by computer processing speed standards, given the speed of light that laser signals travel at and the normal distances between a designator and a target), the seeker can process the received transmitted signals and search for corresponding reflected pulse signals (e.g., encoded patterns of pulse signals matching a pattern transmitted by the designator) during a window around the expected arrival time of any reflected pulses. This window is also referred to as the acceptance gate, and the number of pulses in the acceptance gate provides an approximate or potential target count of the number of targets being sensed by the seeker (only one of which can be the tracked target, or target to which the seeker is locked on).

As can be seen from the PRI plot 110 and the number of pulses plot 120 in FIG. 1, from 1 second to 2 seconds, the seeker is starting to track reflections of the designator pulses, tracking no more than one target at a time, but switching back and forth between the intended target and the secondary target. Then, from 2 seconds to 3 seconds, the seeker continues switching between targets at first, but then settles on the secondary target for a while, but starts to indicate (in the number of pulses received) that it is sensing multiple targets. As time continues progressing, the number of exchanges between intended target and secondary target decreases while the percentage of time the seeker is sensing both targets (e.g., number of pulses=2) increases. Eventually, at about 17.5 seconds after launch of the munition (at point 122), when the munition is about 70 m from the secondary target, the seeker switches to only tracking the secondary target (e.g., number of pulses=1), with impact about 0.35 seconds later.

FIG. 1 illustrates one example of how a laser guided munition can be delivered to an unintended target, in spite of the munition and laser designator working as intended. Other examples can occur, for instance, if the laser designator is transmitting a different code than what the seeker is expecting, or if multiple designators are illuminating the same or different targets with the same or different codes. In these scenarios, the laser designator, the munition, and the deployment of the munition may all work as intended, but the munition may nonetheless miss its intended target (or worse, hit an unintended target). However, in each of these scenarios, a lot of data could be detected and displayed in an easy format to a flight crew prior to launching a precision-guided munition, to enable the flight crew to make a better decision if the circumstances were proper to deploy the munition. While a specific example is illustrated in FIG. 1, in various embodiments, the present device is intended to identify situations such as overspill and allow for corrective action (such as by the flight crew prior to launch of a guided munition).

One or more embodiments of the present disclosure reduce the likelihood of unintended results from precision-guided munitions by providing valuable information (such as laser designator feedback) to flight crews from a small and simple-to-operate device that works independently (e.g., as a portable or standalone device) of the aircraft avionics. This information can include the number of targets being illuminated in the field of view, the designator code or codes being reflected, or the like, which can be useful in determining if it is appropriate to deploy a precision guided munition.

Figure 2:
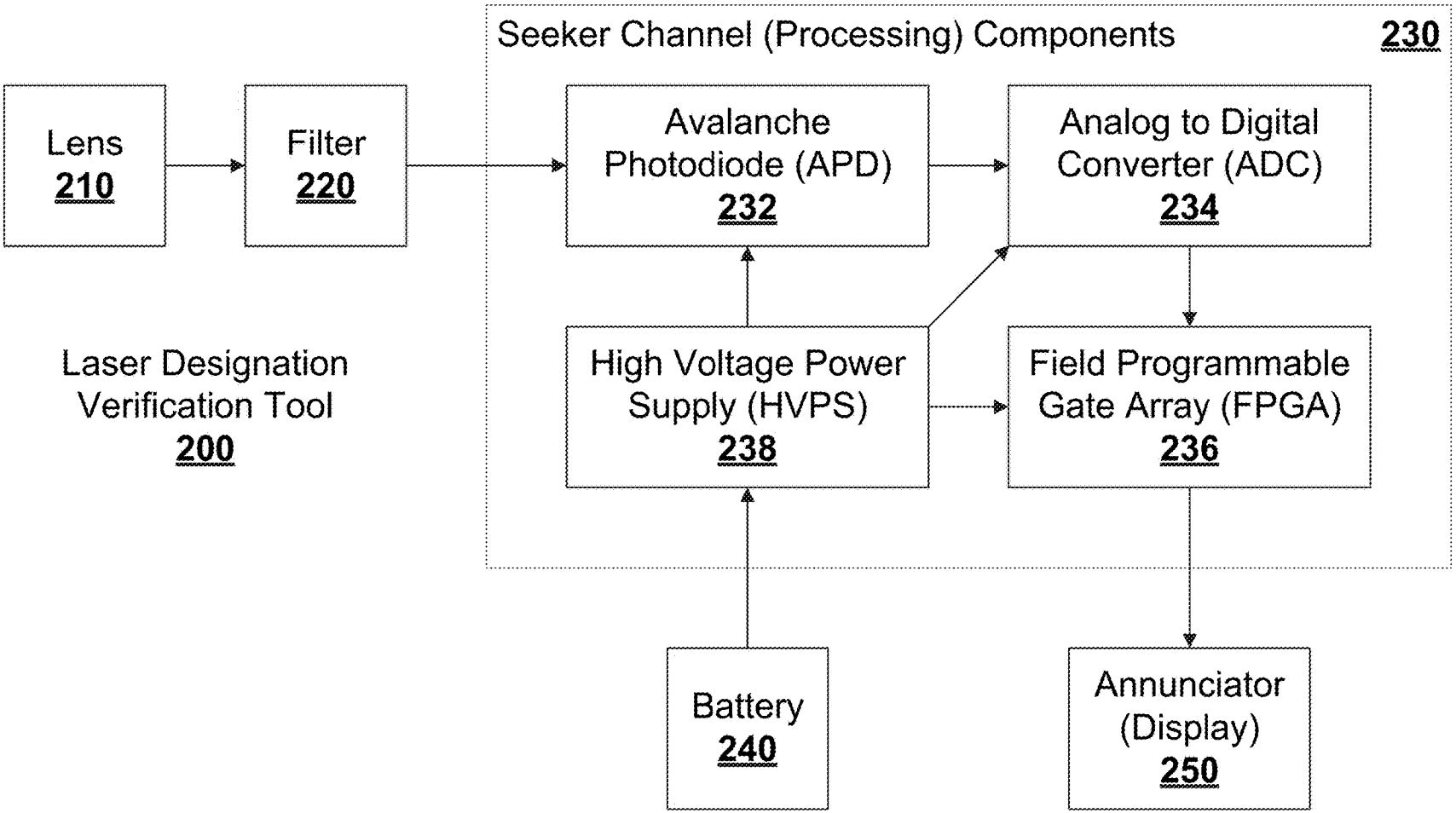
FIG. 2 illustrates an example laser designation verification tool, according to an embodiment of the present disclosure.

FIG. 2 illustrates an example laser designation verification tool 200 according to an embodiment of the present disclosure. The laser designation verification tool 200 may, for instance, have a simple target count display (e.g., the number of laser designator reflections that appear to a guided munition seeker as a target). The tool 200 may have a relatively small size, such as contained in a housing the size of, for example, a thick cell phone, a deck of playing cards, or a palm-size radar detector. The housing may contain all or most of the components (e.g., in some embodiments, annunciator 250 may be separate from the housing that contains the remaining components). The tool 200 may be designed to be placed facing forward (e.g., on the dash of the cockpit) in the general direction of where a laser designator may be aimed. The tool 200 includes a lens 210, which can be an infrared lens, for sensing infrared laser designation reflection signals in the field of view, and a filter 220 for removing some or all of the sensed signals that do not appear to be appropriate laser designation signals being reflected off potential targets. The lens 210 may be on the front of the tool 200, facing forward.

The tool 200 further includes electronics (or seeker channel or processing) components 230, including an avalanche photodiode (APD) 232, an analog to digital converter (ADC) 234, a high voltage power supply (HVPS) 238, and an electronic processor or processing component, such as a field programmable gate array (FPGA) 236 or microprocessor. In other embodiments, the components 230 may be a semi-active laser seeker channel or a subset of (possibly simplified) components from such a seeker channel, which can be a self-contained guidance and control system made up of electronic processing components configured to guide a precision-guided munition to a laser designated target. For example, the APD 232 detects a phase of the reflected laser designator signal, the ADC 234 converts the detected laser designator signal to a digital signal, the FPGA 236 or microprocessor processes the digital signal (e.g., converts it to a code, such as an LSA or laser designator code), and the HVPS 238 powers the electronics components 230 of the tool 200, such as the APD 232, the ADC 234, and the FPGA 236. The tool 200 further includes a battery 240, which may be a rechargeable battery, for powering the device independently of the avionics of the aircraft on which the tool 200 is deployed. In some embodiments, the lens 210, filter 220, electronics 230, and battery 240 may be the same or similar components to those used in a guided munition seeker that perform a similar function.

Externally, the tool 200 outputs the data from the electronics component 230 (e.g., serial data from the FPGA 236) to display some form of target count (e.g., the number of targets or distinct pulse reflections detected in the acceptance gate), such as on the annunciator 250. For example, the annunciator 250 can be part of the housing containing the tool 200 (e.g., on the side opposite the lens 210) or it may be remote from the rest of the tool 200. In one embodiment, the annunciator 250 includes a driver and displays a single digit count, e.g., a 7 segment LED or liquid crystal display (LCD), of the number of targets being sensed by the electronics component 230. In another embodiment, the annunciator 250 includes a driver and a set of multiple LEDs, with a different number or set of LEDs being illuminated to represent a target count, such as one LED for one target, two LEDs for two targets, and three LEDs for three or more targets. The number of targets capable of being concurrently sensed and tracked by the electronics component 230 depends in part on the processing speed and power of the computing element, such as FPGA 236 or similar circuit, such as a microprocessor or microcontroller. In one or more embodiments, 10 or more targets are capable of being concurrently sensed, with a two-digit display to provide the target count.

In some embodiments, the annunciator 250 is on the housing on the opposite side of the lens 210 and the filter 220 (e.g., facing rearward, toward the flight crew and away from the lens 210). In other embodiments, the annunciator 250 may be a remote annunciator (e.g., detachable or movable with respect to the housing, and coupled to the electronics component 230, such as wired or wirelessly). In some embodiments, the annunciator 250 may have a way to indicate that the target counts are stable (e.g., consistently received pulse reflections over several PRI's), such as a blinking display, or a display with decimal point or points, or a separate dedicated LED for indicating stability. In other embodiments, these indicators of stability may be reversed (e.g., blinking means the target counts are unstable, or the dedicated LED may indicate an unstable count). The tool 200 may also include a power switch, such as an on/off switch, for turning the device on and off.

While the annunciator 250 in the tool 200 as described above may be too simple to display the laser designator code (LSA code) or PRF (pulse repetition frequency) code of a sensed laser designator reflection, in some embodiments, the tool 200 can do some form of LSA code processing. For example, in some embodiments, the tool 200 auto-detects the LSA code (e.g., since the tool 200 is used in a somewhat controlled environment, some combination of, for example, the last detected LSA code, or the most frequently occurring LSA code, or the strongest LSA code received may be used). In other embodiments, the desired LSA code may be entered manually (e.g., with dip switches) for direct control or when accuracy is essential (such as certain combat situations). The tool 200 may then only report target counts matching the LSA code, or have some indication (e.g., dashes, rolling LEDs, or the like) if other LSA codes are being received in addition to or instead of the desired LSA code, which can indicate situations such as multiple designators are present or the laser designator is set to the wrong LSA code.

Figures 3A, 3B:
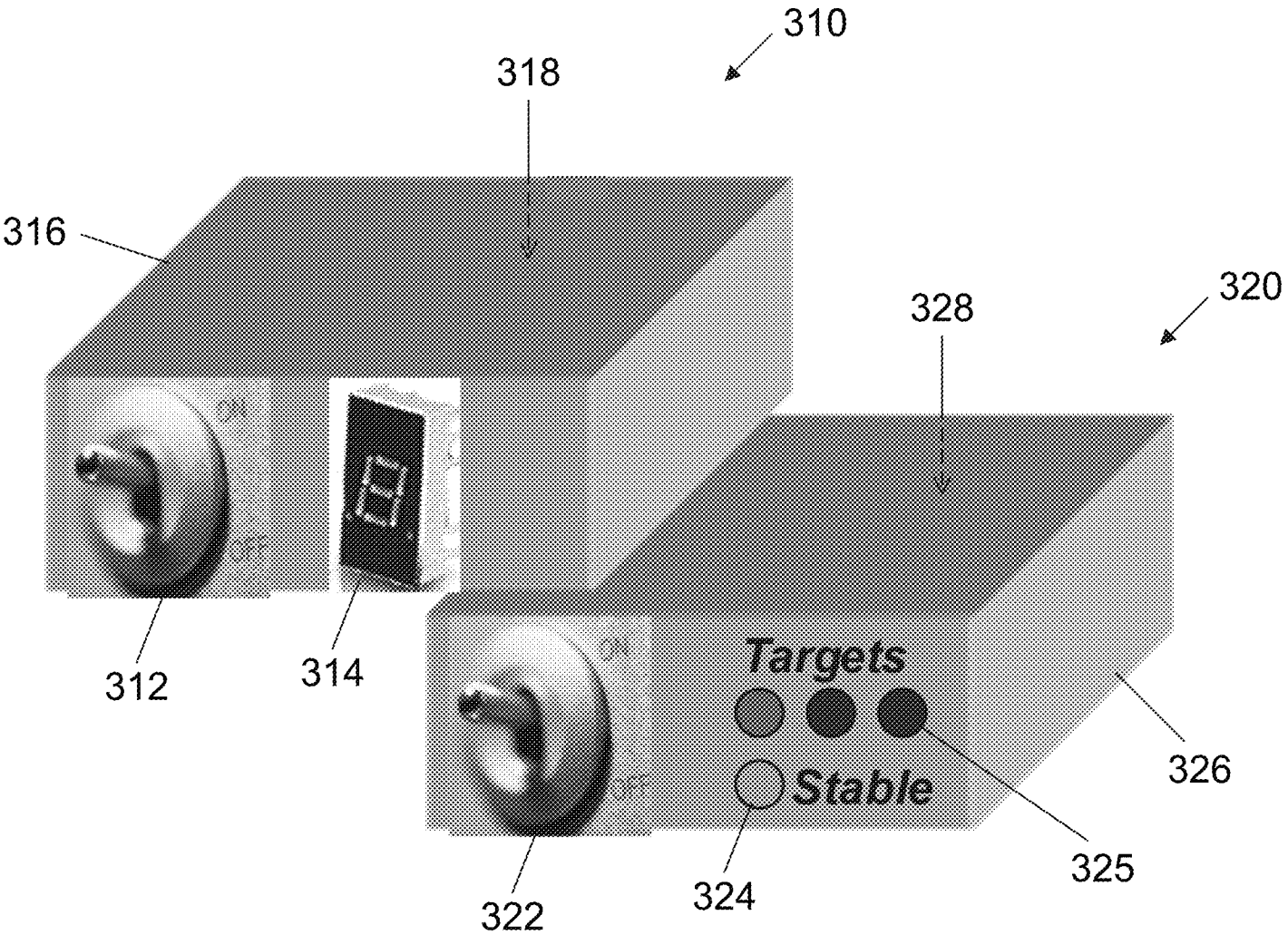
FIGS. 3A-3B, illustrates example laser designation verification tools, according to other embodiments of the present disclosure.

FIG. 3, which includes FIGS. 3A-3B, illustrates example laser designation verification tools 310 and 320 according to other embodiments of the present disclosure. Laser designation verification tools 310 and 320, like tool 200, have simple annunciators 314 and 324, respectively, featuring a target count display. The tools 310 and 320 also have relatively small size, such as contained in a housing (e.g., housings 316 and 326, respectively) the size of a thick cell phone, or a deck of playing cards, or a palm-size radar detector. The tools 310 and 320 may be designed to be placed facing forward (e.g., on the dash of the cockpit) in the general direction of where a laser designator may be aimed. The tools 310 and 320 include a lens (such as lenses 318 and 328, facing away in FIG. 3), which can be an infrared lens, and filter for sensing infrared laser designation signals being reflected off potential targets. The lenses 318 and 328 may be on the front of the tools 310 and 320, respectively, facing forward.

Externally, the tools 310 and 320 output the data from the electronics component (which may be located in the housings 316 and 326, respectively) to display some form of target count (e.g., the number of targets or distinct pulse reflections detected in the acceptance gate), on annunciators 314 (single 7 segment LED/LCD digit) and 324/325 (multiple LEDs), respectively. The annunciators 314 and 324/325 may be simple annunciator panels, for example, on the housings 316 and 326, respectively, on the opposite side of the lenses 318 and 328 (e.g., facing rearward, toward the flight crew and away from the lenses 318 and 328) having a single digit (e.g., LED/LCD digit 314) or set of LEDs 325 to display the target count. The annunciators 314 and 324/325 may have some way to indicate that the target counts are stable (e.g., consistently received pulse reflections over several PRI's), such as a blinking display, or a digit with a decimal point or points (e.g., annunciator 314), or a separate dedicated LED (e.g., LED 324) for indicating stability. The tools 310 and 320 may also include on/off switches 312 and 322, respectively, for turning the devices on and off.

Figure 4:
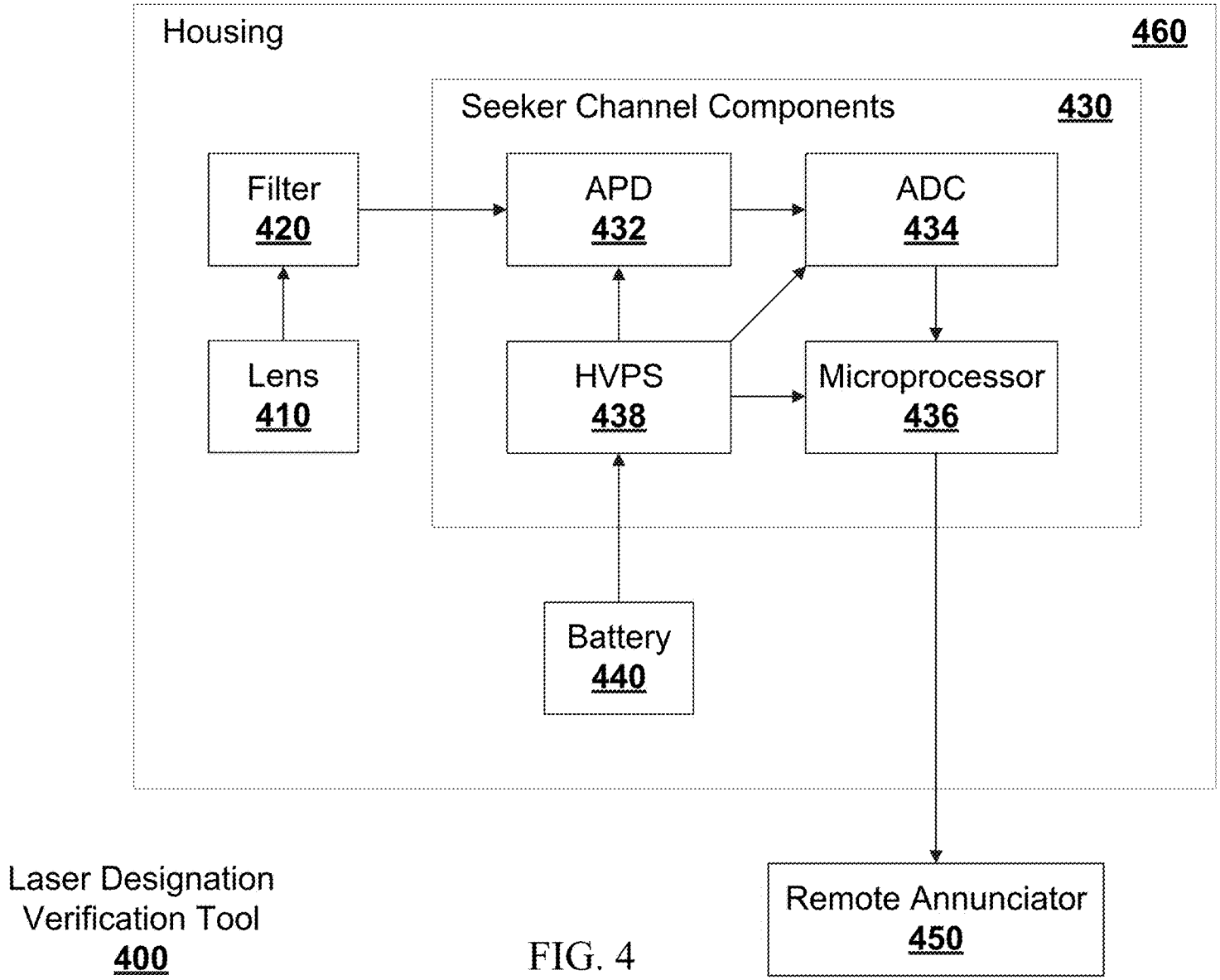
FIG. 4 illustrates an example laser designation verification tool, according to another embodiment of the present disclosure.

FIG. 4 illustrates an example laser designation verification tool 400 according to another embodiment of the present disclosure. Laser designation verification tool 400 is similar to laser designation verification tools 200, 310, and 320, e.g., components such as lens 410, filter 420, electronics (seeker channel) components 430 (including APD 432, ADC 434, microprocessor 436, and HVPS 438), battery 440, and housing 460. In addition, the tool 400 includes a remote annunciator 450 separate from the housing 460 and the rest of the tool 400. for example, the tool 400 may sit just out of sight of the flight crew, so the remote annunciator 450 (which may be connected by a wire or wirelessly to the housing 460 and the rest of the tool 400) may be positioned to be seen by the appropriate flight personnel during flight. The remote annunciator 450 may have a multi-digit display (e.g., LED or LCD, using any number of digits or segments per digit), such as a 4-digit display, to enable the tool 400 to display LSA (or PRF) codes, such as the LSA codes sensed by the lens 410, filtered by the filter 420, and decoded by the electronics component 430.

In one embodiment, the 4-digit display 450 toggles between displaying the detected LSA code (e.g., normally 4 digits) and the corresponding target count (e.g., one digit target count or number of pulses received in acceptance gate). Similar indicators may also be used to indicate stability in the LSA code and target count as described above (e.g., blinking or not blinking, or one or more decimal points, etc.) In some embodiments, the detection of multiple LSA codes causes the LSA code field to blink (e.g., while displaying one of the LSA codes), or to switch between displaying each of the detected LSA codes. In further embodiments, a 5-digit may be used in place of the 4-digit display, which allows the 4-digit LSA code and a one digit target count to be displayed concurrently (e.g., simultaneously). In still other embodiments, only a partial LSA code is displayed (e.g., the last three digits) together with a concurrent display of the target count. In yet still other embodiments, the annunciator 450 displays a signal strength of the decoded LSA code (e.g., as a number from 0 to 100, or as a set of dashes or bars, etc., for different ranges of the signal strength), possibly toggling with the displayed LSA codes and target counts. While some of the described embodiments detail visual displays for the codes, further embodiments provide for other audio and audio/visual designations.

Figure 5:
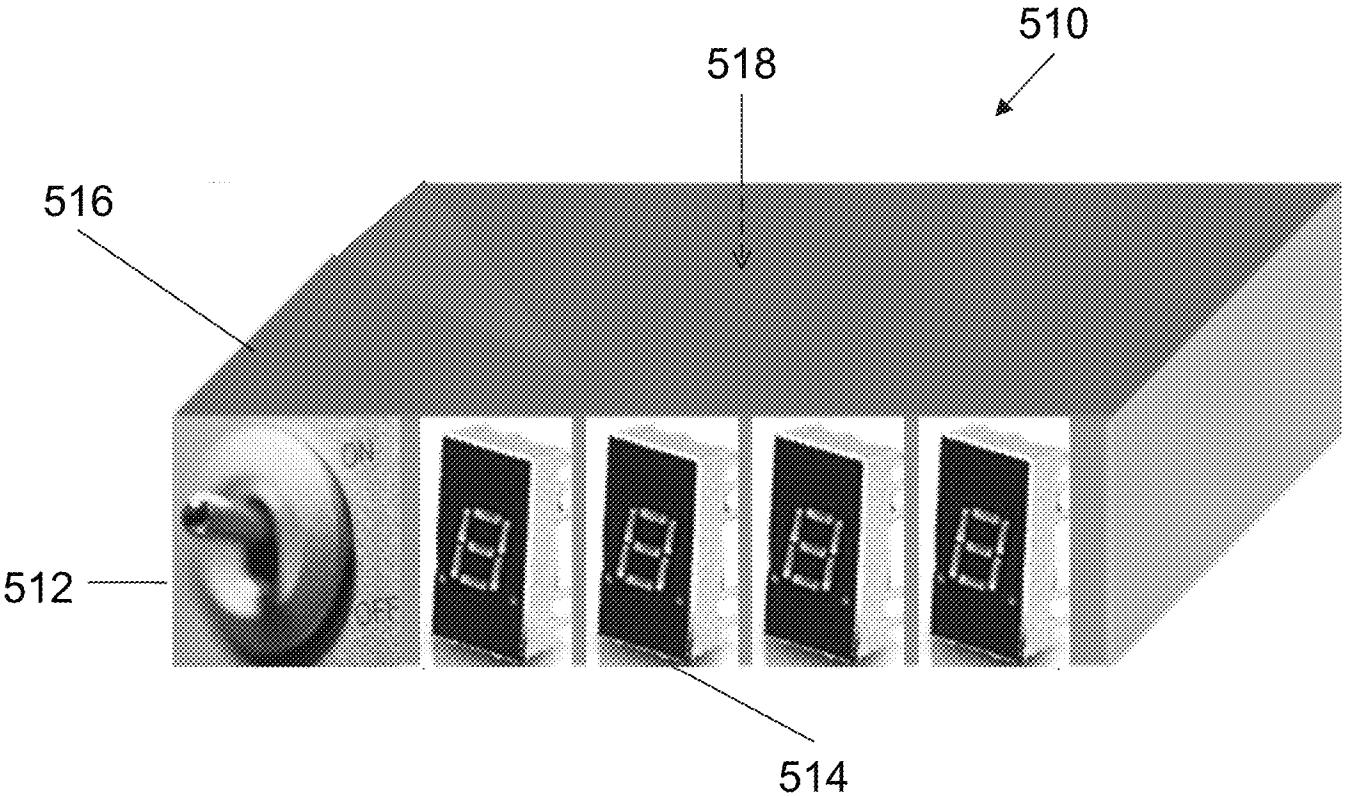
FIG. 5 illustrates an example laser designation verification tool, according to another embodiment of the present disclosure.

FIG. 5 illustrates an example laser designation verification tool 510 according to another embodiment of the present disclosure. Laser designation verification tool 510 is similar to laser designation verification tools 310 and 320 (e.g., components such as lens 518, power switch 512, and housing 516). In addition, the tool 510 includes a 4-digit annunciator 514, to enable the tool 510 to display LSA (or PRF) codes, such as the LSA codes sensed by the lens 518.

Figure 6:
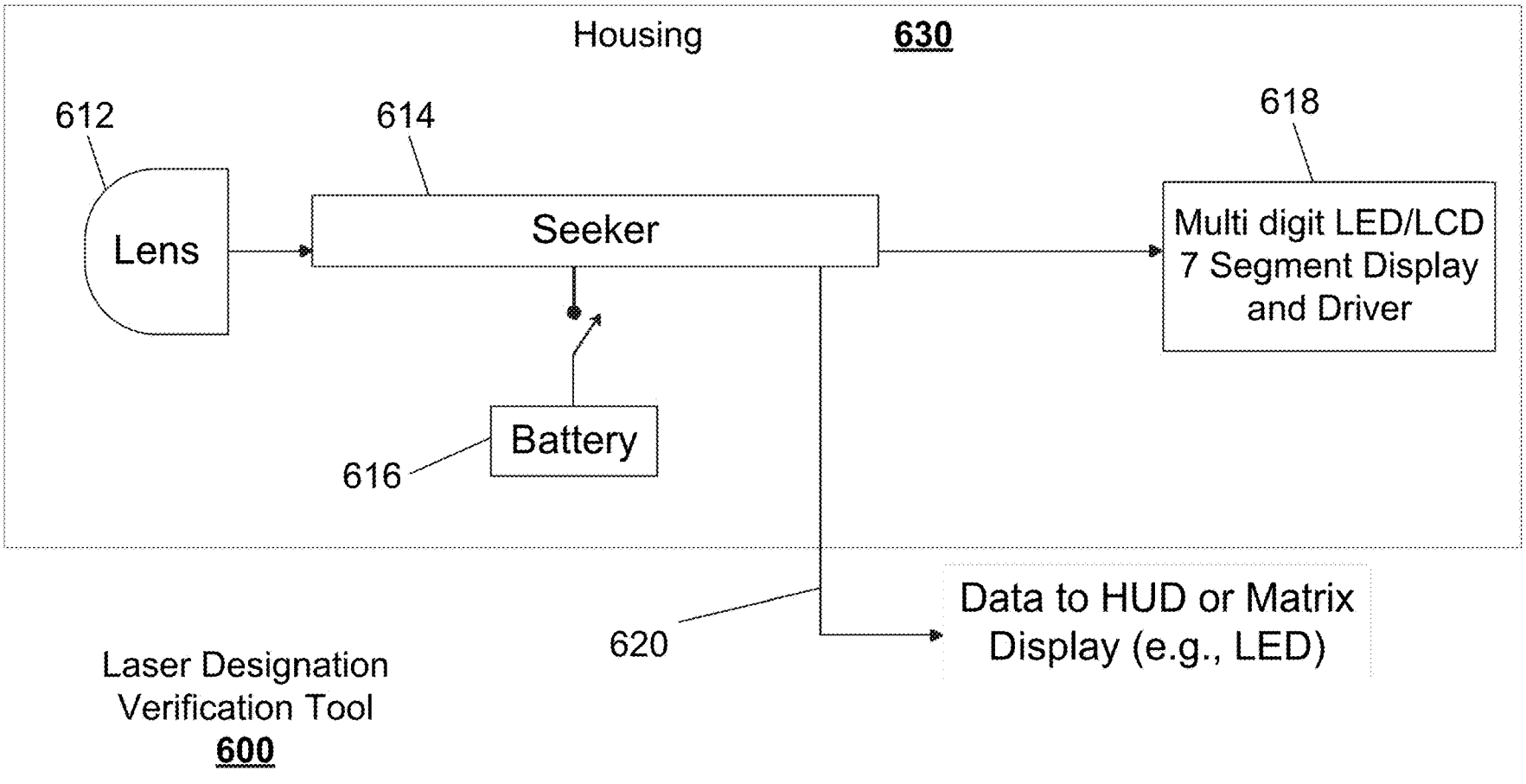
FIG. 6 illustrates an example laser designation verification tool, according to another embodiment of the present disclosure.

FIG. 6 illustrates an example laser designation verification tool 600 according to another embodiment of the present disclosure. Laser designation verification tool 600 is similar to laser designation verification tool 400 (e.g., components such as lens 612, battery 616, multi-digit display 618, and housing 630). Tool 600 further includes a seeker 614, such as electronic components of a guided munition seeker used to control guidance of the munition to a target. By using the components of a seeker, the laser designation verification tool 600 can more accurately display laser designation data as observed (e.g., sensed) by the guided munition. For example, the seeker 614 can provide target count, LSA (PRF) code(s), position (e.g., azimuth and elevation), and probability of a hit data for display on the multi-digit display 618, or send the data on a communication channel 620 (e.g., wired or wireless) to an external display or a heads-up display for display or further display external to the tool 600.

Methodology

Figure 7:
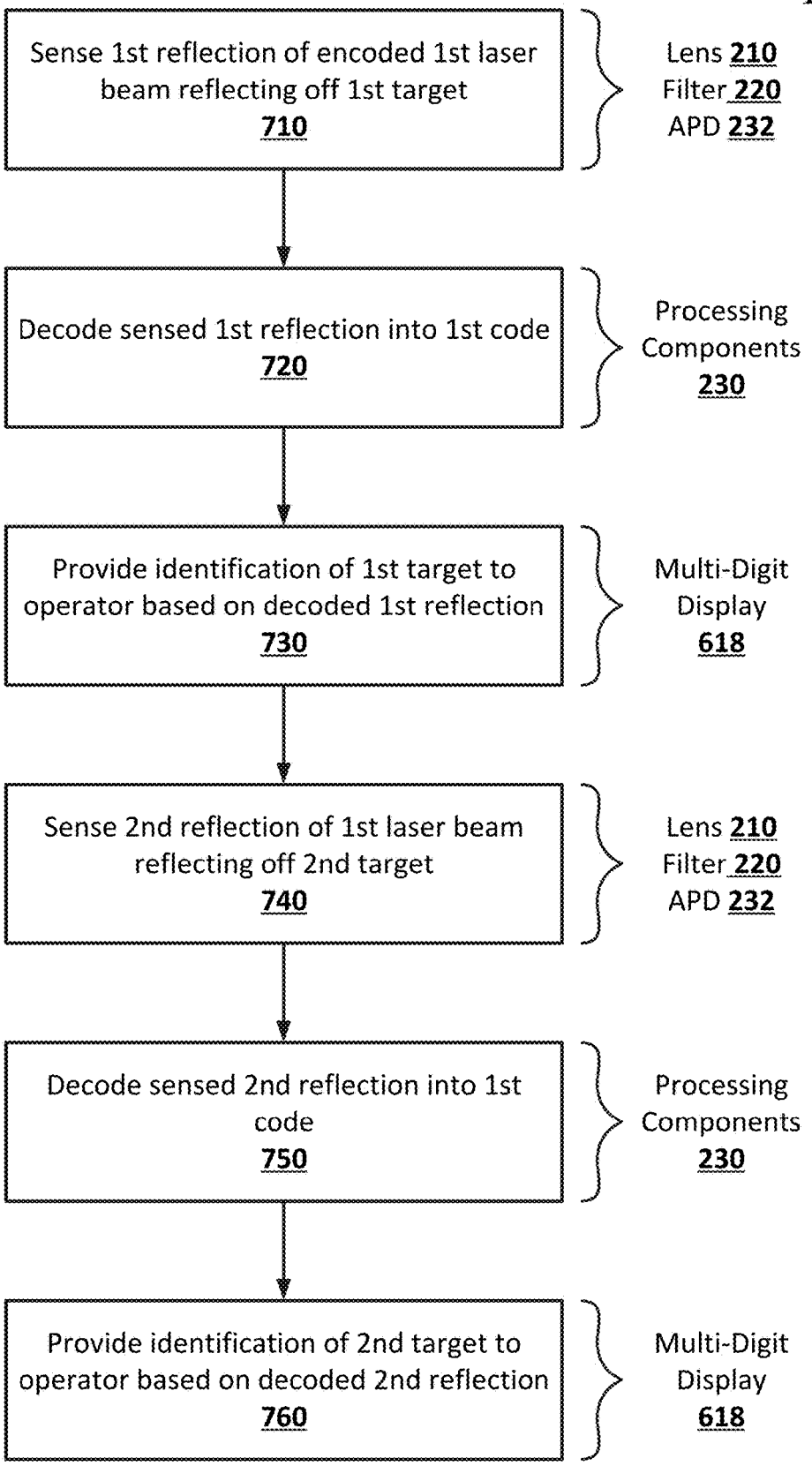
FIG. 7 is a flowchart illustrating an example method for laser designation verification, according to an embodiment of the present disclosure.
Figure 8:
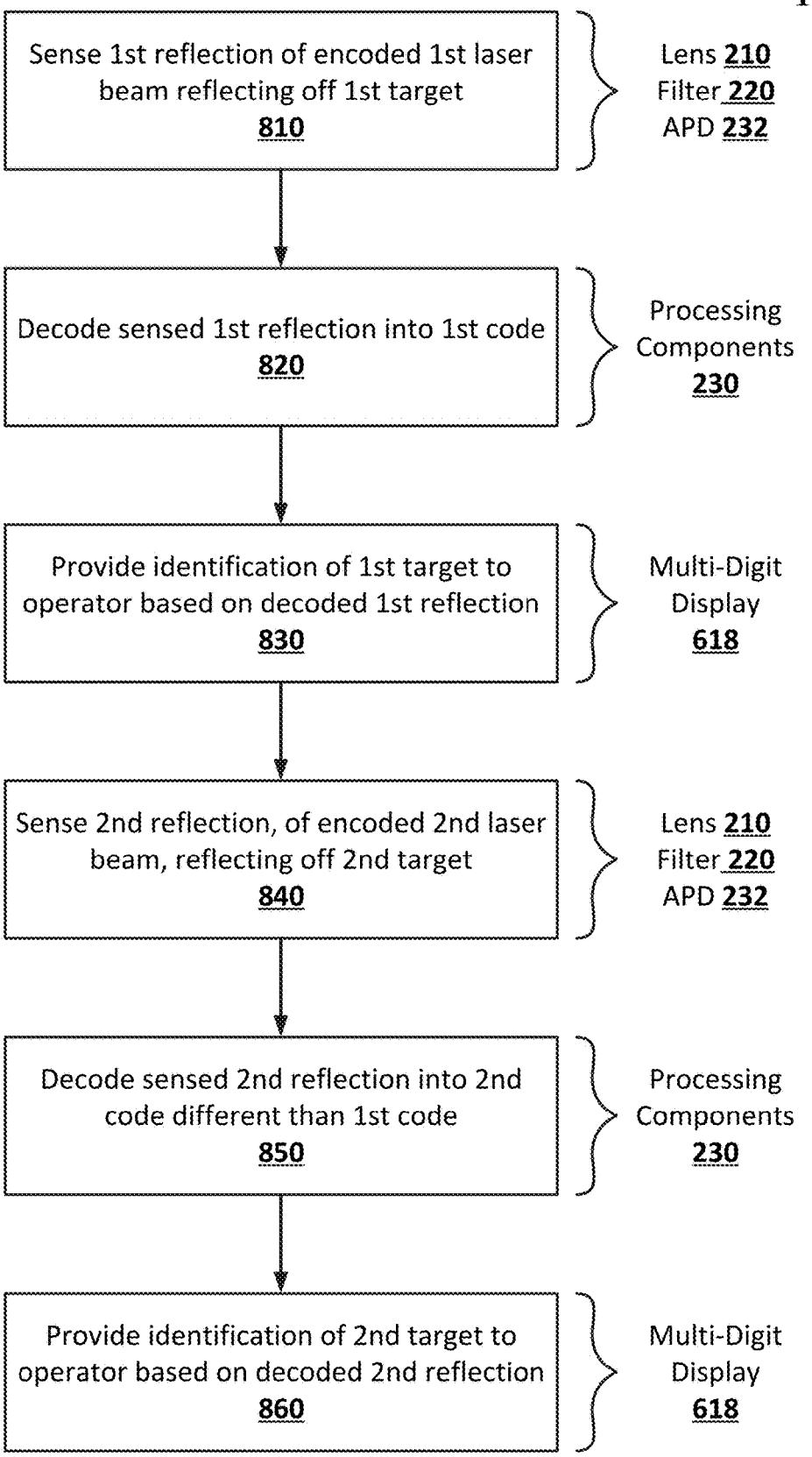
FIG. 8 is a flowchart illustrating an example method for laser designation verification, according to another embodiment of the present disclosure.

FIGS. 7-8 are flowcharts illustrating example methods 700 and 800 for laser designation verification on an aircraft using a laser designation verification tool, according to an embodiment of the present disclosure. As can be seen, example methods 700 and 800 each include a number of phases and sub-processes, the sequence of which may vary from one embodiment to another. However, when considered in the aggregate, these phases and sub-processes form processes for performing laser designation verification using a laser designation verification tool according to some embodiments of the present disclosure. These embodiments can be implemented, for example using the laser designation verification tools illustrated in FIGS. 2-6 as described above. However, other system architectures can be used in other embodiments, as will be apparent in light of this disclosure. To this end, the correlation of the various functions shown in FIGS. 7-8 to the specific components illustrated in FIGS. 2-6 is not intended to imply any structural or use limitations. Rather, other embodiments may include, for example, varying degrees of integration wherein multiple functionalities are effectively performed by one system. For example, in another embodiment, a single module can be used to perform all the functions of methods 700 and 800. Thus, other embodiments may have fewer or more modules or sub-modules depending on the granularity of implementation. Numerous variations and alternative configurations will be apparent in light of this disclosure.

As illustrated in FIG. 7, in one embodiment, method 700 for laser designation verification on an aircraft using a laser designation verification device (e.g., a tool, including a lens, an electronic processing element, and an electronic annunciator) commences, and at operation 710, a first reflection of an encoded first laser beam (and reflected off a first target) is sensed using the lens (such as the lens 210 of FIG. 2, and possibly other components, such as the filter 220 and avalanche photodiode (APD) 232). The encoded first laser beam can be from a laser designator, such as on the aircraft (or, for instance, from the ground, another aircraft, or other designation source), and which is used to guide munitions. The first laser beam can be encoded with a first code (LSA or PRF code), such as a four-digit code. The first target may be an intended target of the munition. At operation 720, the sensed first reflection of the first laser beam is decoded into the first code using the processing element (such as the processing components 230 of FIG. 2).

In operation 730, an identification of the first target, such as a target count (including the first target) or the first code, is provided (e.g., displayed, announced) on the annunciator (such as the multi-digit display 618 of FIG. 6) to an operator of the device (such as a member of a flight crew). For example, the target count can include all objects ("targets") in the path of the first laser beam (e.g., reflecting the laser beam, including multiple targets in situations like overspill or under-spill) and reflecting signals back to the laser designator verification tool, while the first code can be the LSA (or PRF) code used by the designator to illuminate or designate potential targets for precision-guided weapons.

Continuing with method 700 of FIG. 7, in operation 740, a second reflection of the first laser beam (this time reflected off a second target, such as with overspill) is sensed using the lens (such as the lens 210 of FIG. 2) and other components (e.g., filter 220, APD 232, and the like). The second target may be, for example, an unintended target that happens to be in the same direction as the first laser beam (e.g., in an overspill or under-spill situation). In operation 750, the sensed second reflection of the first laser beam is decoded into the first code using the processing element (e.g., in a manner similar to that of operation 720 using the processing components 230 of FIG. 2). In step 760, an identification of the second target, such as the target count (further including the second target), is provided (e.g., displayed or announced) on the annunciator (such as the multi-digit display 618 of FIG. 6) to the operator. This lets the operator know that the laser designator verification tool is identifying multiple (at least two) potential targets illuminated (or designated) by the laser designator. Accordingly, the operator may wish to reconsider or take additional steps before deploying the guided munition.

While method 700 includes a first target and a second target, some other embodiments of the present disclosure are not limited to two targets. For example, in some embodiments, three, four, or more targets are sensed and identified using operations similar to those in method 700, only directed to a third target, a fourth target, and the like.

As illustrated in FIG. 8, in one embodiment, method 800 for laser designation verification on an aircraft using a laser designation verification device (e.g., a tool, including a lens, an electronic processing element, and an electronic annunciator) commences, and at operation 810, a first reflection of an encoded first laser beam (reflected off a first target) is sensed using the lens (such as the lens 210 of FIG. 2 and similar to operation 710 of FIG. 7). At operation 820, the sensed first reflection of the first laser beam is decoded into the first code using the processing element (such as the processing components 230 of FIG. 2 and similar to operation 720 of FIG. 7). In operation 830, an identification of the first target, such as a target count (including the first target) or the first code, is provided (e.g., displayed or announced) on the annunciator (such as the multi-digit display 618 of FIG. 6 and similar to operation 730 of FIG. 7) to an operator of the device (such as a flight crew member).

Continuing with method 800 of FIG. 8, in operation 840, a second reflection, this time of an encoded second laser beam reflected off a second target, is sensed using the lens (such as the lens 210 of FIG. 2 along with other components such as the filter 220 and APD 232). The encoded second laser beam is from a different laser designator using a second LSA code different than the first code. In operation 850, the sensed reflection of the second laser beam is decoded to the second code using the processing element (e.g., in a manner similar to that of operation 820 using the processing components 230 of FIG. 2). In step 860, an identification of the second target, such as the target count (further including the second target), or the first and second codes, is provided (e.g., displayed or announced) on the annunciator (such as the multi-digit display 618 of FIG. 6) to the operator. In some embodiments, an indication of multiple codes may also be provided (e.g., displayed or announced). This lets the operator know that the laser designator verification device is identifying multiple (at least two) laser designators as well as possible multiple potential targets illuminated (or designated) by the laser designators. Accordingly, the operator may wish to reconsider or take additional steps before deploying the guided munition.

As with method 700 above, method 800 includes a first target and a second target, but some other embodiments of the present disclosure are not limited to two targets. For example, in some embodiments, three, four, or more targets are sensed and identified using operations similar to those in method 800, only directed to a third target, a fourth target, and the like.

Numerous specific details have been set forth herein to provide a better understanding of the embodiments. It will be understood by an ordinarily-skilled artisan, however, that the embodiments may be practiced without these specific details. In other instances, well known operations, components, and circuits have not been described in detail so as not to obscure the embodiments. It can be appreciated that the specific structural and functional details disclosed herein may be representative and do not necessarily limit the scope of the embodiments. In addition, although the subject matter has been described in language specific to structural features or methodological acts, it is to be understood that the subject matter defined in the appended claims is not necessarily limited to the specific features or acts described herein. Rather, the specific features and acts described herein are disclosed as example forms of implementing the claims.

Further Example Embodiments

The following examples pertain to further embodiments, from which numerous permutations and configurations will be apparent.

In one example, the device incorporates anti-tamper techniques such that the unit is disabled or inoperable if attempts are made to dismantle or reverse engineer the unit. In a further example, there are authentication implementations to ensure the device is used by the proper persons. Such authentication techniques include biometrics such as facial scanning, retina scan, fingerprint recognition, and the like. The authentication includes passwords and tokens as well as fobs or tokens as well as proximity fobs.

There are other situations where a coded laser is used to designate, or mark an object for the purposes of locating a target, such as a search and rescue team or autonomously guided supplies, or the like, to the target. It is sometimes useful to have a way to confirm that the laser designation is taking place, possibly confirm the designation code, determine the number of valid codes in view, and other such tasks. In some cases, such confirmation is considered a highly desirable part of the deployment of the entity. Systems that currently perform that function often require highly invasive, complex, tightly controlled, and costly dedicated interfaces between a laser seeker and a host platform. By way of illustration, automated delivery of medications to a remote village by a drone benefits from the laser designation and precision guidance.

Example 1 is a laser designation verification device. The device includes: a lens to sense a first reflection, the first reflection coming from an encoded first laser beam reflecting off a first target; an electronic processing element to decode the sensed first reflection into a first code; and a portable electronic annunciator to provide identification of the first target to an operator of the device based on the decoded first reflection.

Example 2 includes the subject matter of Example 1, where the lens is further to sense a second reflection, the second reflection coming from an encoded second laser beam reflecting off a second target, the processing element is further to decode the sensed second reflection into a second code, and the annunciator is further to provide identification of the second target to the operator based on the decoded second reflection.

Example 3 includes the subject matter of Example 1, where the lens is further to sense a second reflection, the second reflection coming from the first laser beam reflecting off a second target, the processing element is further to decode the sensed second reflection into the first code, and the annunciator is further to provide identification of the second target to the operator based on the decoded second reflection.

Example 4 includes the subject matter of Example 1, where the processing element is further to determine a direction of the first target from the sensed first reflection, and the annunciator is further to provide the direction of the first target to the operator.

Example 5 includes the subject matter of Example 1, where the processing element is further to determine a strength of the sensed first reflection, and the annunciator is further to provide the strength of the sensed first reflection to the operator.

Example 6 includes the subject matter of Example 1, further including: a battery to power the device; a power switch to turn the device on and off; and a housing to secure the lens, the processing element, the battery, and the power switch.

Example 7 includes the subject matter of Example 6, where the annunciator includes a remote annunciator configured to deploy separated from the housing.

Example 8 includes the subject matter of Example 7, where the remote annunciator includes a heads-up display.

Example 9 includes the subject matter of Example 1, where the identification includes the first code, the annunciator includes a multi-digit display to display the first code, and the annunciator is further to display the first code on the multi-digit display.

Example 10 includes the subject matter of Example 1, where the processing element is further to determine a target count from the decoded first reflection, and the annunciator is further to display the target count to the operator.

Example 11 is a method of laser designation verification using a device including a lens, an electronic processing element, and a portable electronic annunciator. The method includes: sensing a first reflection using the lens, the first reflection coming from an encoded first laser beam reflecting off a first target; decoding the sensed first reflection into a first code using the processing element; and providing, by the annunciator to an operator of the device, identification of the first target based on the decoded first reflection.

Example 12 includes the subject matter of Example 11, further including: sensing a second reflection using the lens, the second reflection coming from an encoded second laser beam reflecting off a second target; decoding the sensed second reflection into a second code using the processing element; and providing, by the annunciator to the operator, identification of the second target based on the decoded second reflection.

Example 13 includes the subject matter of Example 11, further including: sensing a second reflection using the lens, the second reflection coming from the first laser beam reflecting off a second target; decoding the sensed second reflection into the first code using the processing element; and providing, by the annunciator to the operator, identification of the second target based on the decoded second reflection.

Example 14 includes the subject matter of Example 11, further including: determining a direction of the first target from the sensed first reflection using the processing element; and providing, by the annunciator to the operator, the direction of the first target.

Example 15 includes the subject matter of Example 11, further including: determining a strength of the first target from the sensed first reflection using the processing element; and providing, by the annunciator to the operator, the strength of the sensed first reflection.

Example 16 is a portable laser designation verification tool. The tool includes: a lens to sense a first reflection, the first reflection coming from an encoded first laser beam reflecting off a first target; an electronic processing device to decode the sensed first reflection into a first code; an electronic annunciator to provide a target count or the first code to an operator of the device, the target count including the first target; a battery to power the tool; and a housing to secure the lens, the processing device, the annunciator, and the battery into a portable package.

Example 17 includes the subject matter of Example 16, where the lens is further to sense a second reflection, the second reflection coming from an encoded second laser beam reflecting off a second target, the processing device is further to decode the sensed second reflection into a second code, and the annunciator is further to provide the target count or the second code to the operator, the target count further including the second target.

Example 18 includes the subject matter of Example 16, where the lens is further to sense a second reflection, the second reflection coming from the first laser beam reflecting off a second target, the processing device is further to decode the sensed second reflection into the first code, and the annunciator is further to provide the target count to the operator, the target count further including the second target.

Example 19 includes the subject matter of Example 16, where the processing device is further to determine a direction of the first target from the sensed first reflection, and the annunciator is further to provide the direction of the first target to the operator.

Example 20 includes the subject matter of Example 16, where the processing device is further to determine a strength of the sensed first reflection, and the annunciator is further to provide the strength of the sensed first reflection to the operator.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents. Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications. It is intended that the scope of the present disclosure be limited not be this detailed description, but rather by the claims appended hereto. Future filed applications claiming priority to this application may claim the disclosed subject matter in a different manner, and may generally include any set of one or more elements as variously disclosed or otherwise demonstrated herein.

What is claimed is:

1. A laser designation verification device comprising:

a lens to receive a first reflection, the first reflection coming from an encoded first laser beam reflecting off a first target;

an electronic processing element to decode the first reflection into a first code, wherein the electronic processing element includes a single avalanche photodiode (APD);

a portable electronic annunciator to provide identification of the first target based on the first reflection detected by the single APD;

a power source; and a housing to secure the lens, the electronic processing element, the portable electronic annunciator and the power source without any external electrical or wireless connectivity, and wherein the laser designation verification device is a standalone device.

2. The device of claim 1, wherein the lens receives a second reflection, the second reflection coming from an encoded second laser beam reflecting off a second target, the processing element decodes the second reflection into a second code different than the first code, and the annunciator provides identification of the second target based on the second reflection.

3. The device of claim 1, wherein the lens receives a second reflection, the second reflection coming from the first laser beam reflecting off a second target, the processing element decodes the second reflection into the first code, and the annunciator provides identification of the second target based on the second reflection.

4. The device of claim 1, wherein the processing element determines a direction of the first target from the first reflection, and the annunciator provides the direction of the first target.

5. The device of claim 1, wherein the processing element determines a strength of the first reflection, and the annunciator provides the strength of the first reflection.

6. The device of claim 1, further comprising:

a battery to power the device as the power source; and a power switch to turn the device on and off;

wherein the housing secures the battery and the power switch.

7. The device of claim 1, wherein the identification comprises the first code, the annunciator comprises a multi-digit display to display the first code, and the annunciator displays the first code on the multi-digit display.

8. The device of claim 1, wherein the processing element determines a target count from the decoded first reflection, and the annunciator displays the target count.

9. The device of claim 1, wherein the annunciator comprises an audible indicator or a visual display.

10. The device of claim 1, wherein the lens provides a wide angle forward view.

11. A method of laser designation verification using a standalone device comprising a lens, an electronic processing element, and a portable electronic annunciator in a housing, wherein the electronic processing element includes a single avalanche photodiode (APD), an analog to digital converter (ADC) and a microprocessor, the method comprising:

receiving a first reflection using the lens, the first reflection coming from an encoded first laser beam reflecting off a first target, wherein the single APD detects the first reflection and converting to a digital signal by the ADC;

decoding the digital signal from the first reflection into a first code using the microprocessor; and providing, by the annunciator, identification of the first target based on the first reflection without any external electrical or wireless connectivity.

12. The method of claim 11, further comprising:

receiving a second reflection using the lens, the second reflection coming from an encoded second laser beam reflecting off a second target;

decoding the second reflection into a second code using the processing element, the second code being different than the first code; and providing, by the annunciator, identification of the second target based on the decoded second reflection.

13. The method of claim 11, further comprising:

receiving a second reflection using the lens, the second reflection coming from the first laser beam reflecting off a second target;

decoding the second reflection into the first code using the processing element; and providing, by the annunciator, identification of the second target based on the decoded second reflection.

14. The method of claim 11, further comprising:

determining a direction of the first target from the first reflection using the processing element; and providing, by the annunciator, the direction of the first target.

15. The method of claim 11, further comprising:

determining a strength of the first target from the first reflection using the processing element; and providing, by the annunciator, the strength of the first reflection.

16. A portable standalone laser designation verification tool comprising:

a lens to receive a first reflection, the first reflection coming from an encoded first laser beam reflecting off a first target;

an electronic processing device to decode the first reflection into a first code, wherein the electronic processing device comprises a single avalanche photodiode (APD), an analog to digital converter, and a microprocessor;

an electronic annunciator to provide a target device count, the target count comprising the first target;

a battery to power the tool; and a housing to secure the lens, the processing device, the annunciator, and the battery into a portable package, wherein the lens is on a first side of the housing and the annunciator is on a second side of the housing, without any external electrical or wireless connectivity.

17. The tool of claim 16, wherein the lens receives a second reflection, the second reflection coming from an encoded second laser beam reflecting off a second target, the processing device decodes the second reflection into a second code different than the first code, and the annunciator provides the target count or the second code, the target count further comprising the second target.

18. The tool of claim 16, wherein the lens senses a second reflection, the second reflection coming from the first laser beam reflecting off a second target, the processing device decodes the sensed second reflection into the first code, and the annunciator provides the target count, the target count further comprising the second target.

* * * * *